US007122742B2

(12) United States Patent
King, Jr. et al.

(10) Patent No.: US 7,122,742 B2
(45) **Date of Patent: *Oct. 17, 2006**

(54) STRAIN RELIEVED WIRE CONNECTOR

(75) Inventors: Lloyd Herbert King, Jr., Chesterfield, MO (US); Michael Belgeri, Ellisville, MO (US); James Keeven, O'Fallon, MO (US)

(73) Assignee: The Patent Store L.L.C., St. Charles, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/928,669

(22) Filed: Aug. 26, 2004

(65) Prior Publication Data

US 2005/0045362 A1 Mar. 3, 2005

Related U.S. Application Data

(63) Continuation-in-part of application No. 10/654,076, filed on Sep. 3, 2003, now Pat. No. 6,815,616.

(51) Int. Cl.
*H01R 4/00* (2006.01)

(52) U.S. Cl. ..... 174/87

(58) Field of Classification Search ..... 174/87
See application file for complete search history.

(56) References Cited

U.S. PATENT DOCUMENTS

| | | | | |
|---|---|---|---|---|
| 3,339,011 | A * | 8/1967 | Ewers, Jr. et al. | 174/92 |
| 4,438,995 | A * | 3/1984 | Fisher et al. | 439/147 |
| 4,740,656 | A | 4/1988 | Rich | 174/87 |
| 5,113,037 | A | 5/1992 | King, Jr. et al. | 174/87 |
| 5,315,066 | A | 5/1994 | Spiteri, Sr. | 174/87 |
| 5,357,057 | A | 10/1994 | Debbaut | 174/84 |
| 5,431,758 | A | 7/1995 | Delalle | 156/49 |
| 5,559,307 | A | 9/1996 | Whitehead et al. | 174/87 |
| 5,894,110 | A | 4/1999 | Simmons et al. | 174/87 |
| 6,478,606 | B1 | 11/2002 | McNerney et al. | 439/415 |
| 6,570,094 | B1 | 5/2003 | King, Jr. | 174/87 |
| 6,815,616 | B1 * | 11/2004 | King et al. | 174/87 |

* cited by examiner

*Primary Examiner*—Chau N. Nguyen
(74) *Attorney, Agent, or Firm*—Jacobson & Johnson

(57) ABSTRACT

A twist-on wire connector having a housing with a spiral tread for engaging and holding electrical wires in an electrical connection and a chamber for carrying a member having a wire passageway so that the electrical wires can be retained within the connector by a wire holder to inhibit strain therein and a method of making an electrical connection that inhibits strain of the wire by inserting a plurality of wires into a spiral thread of a twist-on wire connector, rotating the plurality of wires to bring the electrical wires into electrical connection with each other and squeezing a member around the plurality of wires to bring the member into frictional contact along a portion of the plurality of wires to axially restrain the plurality of wires and thereby inhibit strain on the plurality of wires held in the electrical connector.

4 Claims, 7 Drawing Sheets

STRAIN RELIEVED WIRE CONNECTOR

CROSS REFERENCE TO RELATED APPLICATIONS

This application is a continuation in part of patent application Ser. No. 10/654,076 Title Strain Relieved Wire Connector filed Sep. 3, 2003 now U.S. Pat. No. 6,815,616.

FIELD OF THE INVENTION

This invention relates generally to a strain relieved wire connector and more specifically to strain relieved twist-on wire connectors that lessen the likelihood that the frictionally joined wires held therein will be dislodged or loosened due to external forces and to a method of making an electrical connection that inhibits or reduces strain on the electrical wires located in the connector.

STATEMENT REGARDING FEDERALLY SPONSORED RESEARCH OR DEVELOPMENT

None.

REFERENCE TO A MICROFICHE APPENDIX

None.

BACKGROUND OF THE INVENTION

A number of connectors are known in the art for holding wires in electrical connectors. A number of different embodiments are known for use in relation twist-on wire connectors or related connectors. The following are examples of various connectors that include some type of assistance for holding the wires within the connector.

U.S. Pat. Nos. 5,151,239; 5,113,037; 5,023,402 and Re 37,340 show a twist-on wire connector with external clips that the wire is looped around to hold the wire in the connector.

U.S. Pat. No. 6,025,559 discloses a twist-on wire connector where the wires are joined in a bundle and inserted into the twist-on wire connector.

U.S. Pat. No. 6,051,791 shows a connector wherein wires are twisted and wrapped around a v-shaped slot in a shell to hold the wires in position as the wires are inserted into a sealant.

U.S. Pat. No. 5,315,066 shows a twist-on wire connector wherein a barrier layer is hardened around the wires in a twist-on wire connector to hold the wires in the wire connector.

U.S. Pat. No. 5,083,003 shows an enclosure to prevent the wires from being removed from the housing.

U.S. Pat. No. 4,839,473 discloses a splice enclosure where a twist-on wire connector is held within a housing with the entire twist-on wire connector is inserted in the housing and the wires are inserted into channels in order to strain relive the connection.

U.S. Pat. No. 4,053,704 discloses a wire connector having the a plug with arms on a plug to restrain the wires in the connector.

U.S. Pat. No. 3,109,051 shows an electrical connector with a locking element having openings therein for inserting wires to hold the wires in the connector.

Although the art is replete with various members to hold the electrical wires in the electrical connector through hooking or looping the wire around a member there is need for a connector that minimizes or reduces the strain on a plurality of wires that are secured in a twist-on wire connectors. In addition, there is a need for a simple easy to use twist-on wire connector that can secure the wires into an electrical connection as well as secure the wires in a strain free condition in the wire connector either during the insertion of the wires into the connector or after the wires have been inserted into the electrical connector. The present invention provides for on-the-go formation of an electrical connection that inhibits strain on the electrical connections and permits a user to reuse or readjust the wires in the electrical connector.

SUMMARY OF THE INVENTION

A twist-on wire connector having a housing with a spiral thread for engaging and holding electrical wires in an electrical connection and a chamber for carrying a member having a wire passageway so that the wires can be retained within the connector by axially restrain the wires to thereby inhibit strain on the wires and a method of making an electrical connection that inhibits strain of the wire by inserting a plurality of wires into a spiral thread of a twist-on wire connector, rotating the plurality of wires with respect to the connector to bring the electrical wires into electrical connection with each other and forcing a wire holder around the plurality of wires to bring the wire holder into pressure contact with the plurality of wires over an extended region to thereby inhibit strain on the plurality of wires held in the electrical connector.

DESCRIPTION OF THE PREFERRED EMBODIMENT

Figure 1:
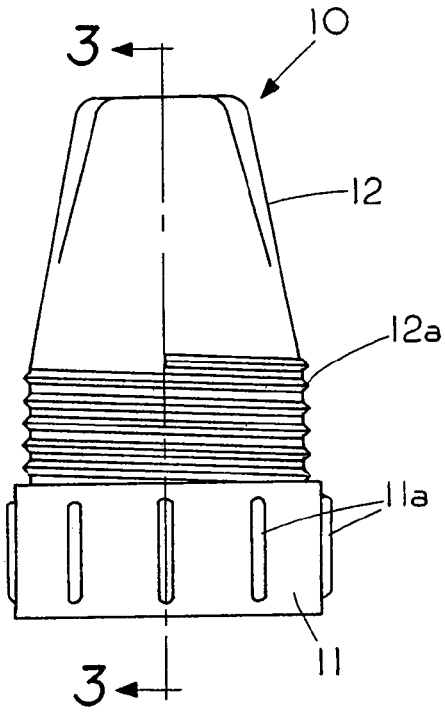
FIG. 1 is a front elevation view of the strain inhibiting twist-on wire connector.

FIG. 1 is a front elevation view of the strain inhibiting twist-on wire connector 10 having an electrically insulating housing or shell 12 having a closed end and an open end with a set of external male threads 12*a* extending around the peripheral region proximate the open end of the housing 12. Located on the open end of housing 12 is an open ended, flanged cap 11 with an internal threaded sidewall for engaging the threads 12*a* on housing 12. A set of elongated finger grips 11*a* extend transversely thereon to enable one to grasp and rotate end cap about housing 12.

Figure 2:
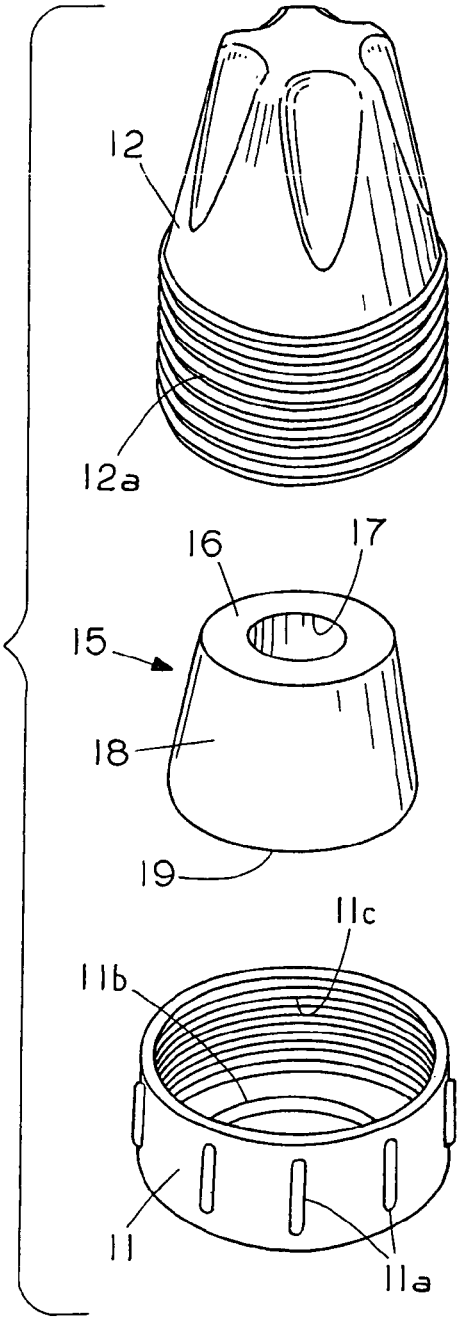
FIG. 2 is an exploded view of the strain inhibit twist-on wire connector of FIG. 1.

FIG. 2 is an exploded view of the strain inhibiting twist-on wire connector 10 showing the housing 12 with the external threads 12*a* thereon. Located below housing 12 is a wire engaging member comprising deformable insert 15 having a top annular surface 16, a bottom annular surface 19 a conical taper sidewall 18 and a central wire passageway 17 extending axially through the deformable insert 15. Located below the deformable insert is the open ended cap 11 having a flange 11*b* for engaging a portion of deformable insert 12 end surface 19 and a set of internal threads 11*c* for rotatingly engaging the thread 12*a* on exterior of housing 12 to enable one to simultaneously squeeze the deformable insert into a chamber in the housing 12 and about a wire or wires extending therethrough as well as against an interior side wall of housing 12.

Figure 3:
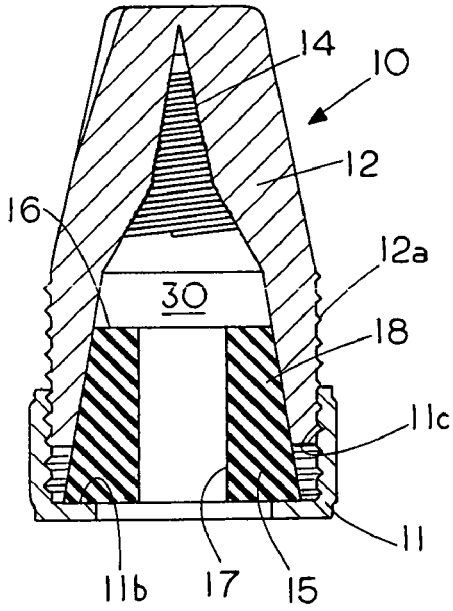
FIG. 3 is a sectional view taken along lines 3—3 of FIG. 1.

FIG. 3 is a sectional view taken along lines 3—3 of FIG. 1 showing twist-on wire connector 10 in cross section but without any wires therein in order to reveal a wire coil 14 located at the closed end with the wire coil having a spiral thread therein for engaging and holding the ends of twisted wire leads therein. In the embodiment shown the spiral thread is formed in a wire coil 14 and the wire coil 14 is then inserted in the housing 12. In an alternate embodiment the spiral thread can be formed directly into the internal surface or side wall of the housing thereby eliminating the need for a separate wire coil for engaging the wires therein.

Deformable member 15 comprises a collar having a frusto conical shape and is shown with an external tapered surface 18 in contact engagement with an internal tapered surface 12*c* located on the interior of housing 12. Located in the open end of housing 12 is a chamber 30 with deformable member 15 located partially in chamber 30. In the embodiment shown cap 11 is in partial engagement with threads 12*a* and the wire passageway 17 is in a open or unengaged condition for insertion of electrical wires therethrough. Deformable member 15 is positioned so that axial insertion of deformable member toward the closed end of housing 12, i.e. by rotation of cap 11, causes the rigid side walls 12*c* to compress the deformable member 15 through radial pressure on deformable member 15 side wall 18 which in turn causes the deformable member to contract the diameter of the passageway 17 and bring the deformable member into engagement with any wires therein.

In the embodiment shown the wire holder comprises a deformable member 15 which is a solid yet yieldable material that can be squeezed to conform to the external surfaces of wires extending therethrough yet retain its structural integrity so that when a surface of the solid is engaged with the wire or wires it provides frictional resistance to displacement of the wires with respect to the solid. While various yieldable solids that retain there integrity can be used the advantage of using a resilient solid such as an elastomer or rubber member is that one can release the frictional grip on the wires in the solid by relaxing the compressive pressure on the wires. Thus the connector becomes reusable as well as suitable for adding additional wires to the connector.

In order to obtain strain relieving engagement between the member 15 and the wires the relationship of the size or cross sectional area of the wire passageway therein to the external dimensions or cross sectional area of a wire extended therethrough is such that when the cap 11 is brought into engagement the deformable member deforms about an exterior surface of the wire to cushioningly engage and support at least a portion of wire therein. By using an elastomer material that is sufficiently soft to yield as an external bending or pulling force is placed on the wire it distributes any force on the wire over a wide area and avoids any sharp bends or kinks in the wire. That is, the elastomer material allows the wires to form a gradual curve if a force is applied to the wire as opposed to an abrupt angle, such as when the wire is held in a clamp. Thus it can be appreciated that the wires are resiliently or yieldable held in the end of the wire connector so that a limited amount of flexing and bending of the wires can occur over an extended region of the wires thus minimizing strain on the wires as well as strain on the ends of the wire that are in electrical contact in the wire connector.

If one wants to prevent moisture from entering therepast the deformable member is compressed or deformed until the deformable member 15 deforms or flows completely around the wires 28 and 29 to fill any gaps between the wires and the sidewall passageway 17 to thereby prevent moisture from entering into the wire connecting chamber in the wire connectors.

In the unengaged condition or ready to use condition, which is illustrated in FIG. 3, the end cap 11 is in engagement with housing 12 but the end cap 11 has not been brought into full engagement with housing 12. In this condition the deformable member 15 is in a relaxed condition ready to be compressed and squeezed.

Figure 4:
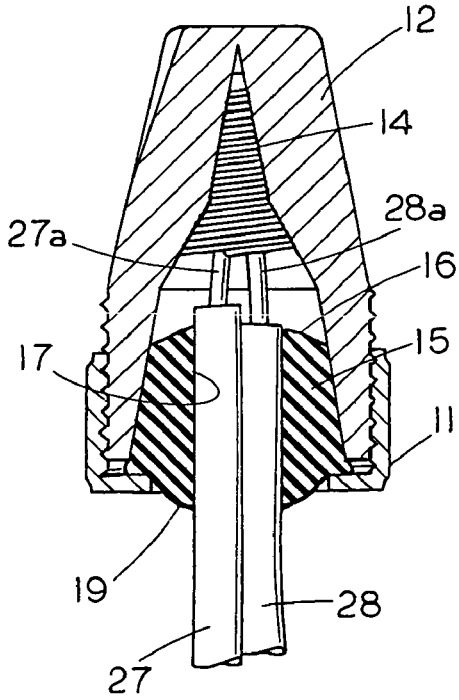
FIG. 4 is a cross sectional showing a plurality of wires in a wire restraining condition in the strain inhibit twist-on wire connector of FIG. 1.

FIG. 4 shows the twist-on wire connector in the strain inhibiting mode with an electrical wire 27*a* and an electrical wire 28*a* in electrical engagement with each other in the spiral coil 14. The electrical wire insulation cover 27 of electrical wire 27*a* and the electrical wire insulation cover 28 of wire 28*a* extend through the passageway 17. FIG. 4 shows the end cap 11 has been partially rotated to squeeze and compress member 15 about the electrical wire covers 27 and 28. As can be seen in FIG. 4, the deformable material has been forced to flow around the wire covers 27 and 28 to thereby engage the wire covering to frictionally grip and assist in retaining the wire covers 27 and 28 in relation to the deformable member 15. As the deformable member 15 is held in position in housing 12 by the flanged end cap 11 the wires are restrained from axial movement in connector 12 and since the deformable member extends over a substantial length of the wires the wires are held in strain inhibiting condition in wire connector housing 12.

Figure 5:
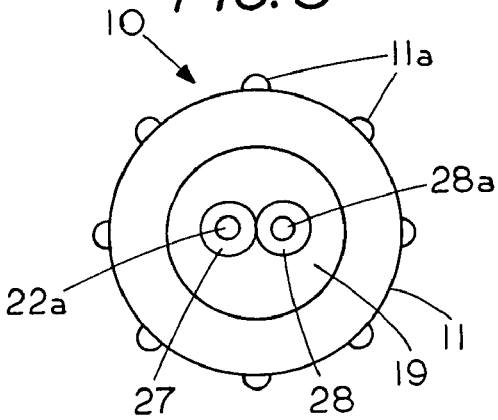
FIG. 5 is an end view of the strain inhibit twist-on wire connector of FIG. 4.

FIG. 5 shows an end view of the connector 10 showing how the deformable member 19 has been deformed about the exterior wire covers 28 and 29 with the wires extending through the central opening in the flanged end cap 11. In the embodiment shown the deformable member 15 has been compressed radially inward to form an enclosure or moisture sealing engagement around wire covers 27 and 28. Thus, through a rotation of end cap 11 one can squeeze deformable member 15 about the electrical leads to bring the electrical leads into tight engagement with the deformable member to not only anchor the electrical leads but to provide a strain inhibiting electrical connection since any lateral strain on the wires is absorbed over an extended area by the yieldable member 15 which extends into the housing 12.

Figure 6:
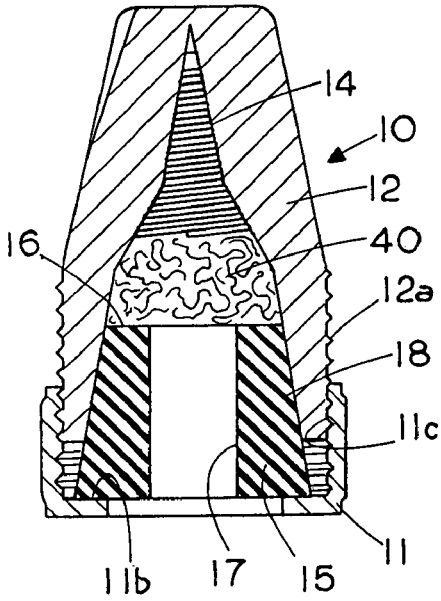
FIG. 6 is a cross sectional view of strain inhibit twist-on wire connector with a viscous sealant located therein.

FIG. 6 shows an alternate embodiment of the twist-on wire connector 10 wherein a viscous sealant 40 is located in the chamber in the housing of connector 10. This embodiment is suitable for those conditions where the deformable member 15 may not be sufficiently radially compressible to form a leakproof seal along the length of the wire in the deformable member 15.

The invention thus comprises a method of inhibiting strain in a set of wires joined in a twist-on wire connector by inserting a plurality of wires through a deformable member and into a spiral thread of a twist-on wire connector, rotating the plurality of wires to bring the electrical wires into an electrical connection with each other and squeezing the deformable members around the plurality of wires to bring the deformable member into extended area pressure contact with the plurality of wires to thereby frictionally engage the plurality of wires to prevent withdrawal and thereby inhibit strain on the plurality of wires held in the electrical connection.

The strain relief connector of the invention includes the well known twist-on wire connector carrying a spiral thread thereon for engaging a wire therein. A radial compression member; and a radially deformable member cooperate and coat to produce a radial compressive force on the wire to retain a wire from being pulled out of the twist-on wire connector. A radially deformable member contains materials that has a frictional wire engaging surface with the radial deformable member normally located in the radial compression member. The radial deformable member generally includes an axially extending collapsible wire passageway therethrough to permit a wire access to the spiral thread of the twist-on wire connector through the wire passageway when the collapsible wire passage is in an uncollapsed condition and to inhibit withdrawal when the wire passageway is in a collapsed condition. The radially deformable member displaceably coacts with a radial compression member to radially collapses the axial passageway as one radially compress the radial deformable member into an extended frictional wire supporting condition to inhibit strain on the wire connection in the twist-on wire connector. Thus the radial pressure generated by the radial deformation of the radially deformable member creates a frictional resistant to movement of a wire or wires therein. In addition the radially deformable member provides wire support over an extended region of the wire.

While the yieldable member 15 is shown as a one-piece collar with a cylindrical opening it is envisioned that two or more members could be used for grasping and holding the electrical wires.

Figure 7:
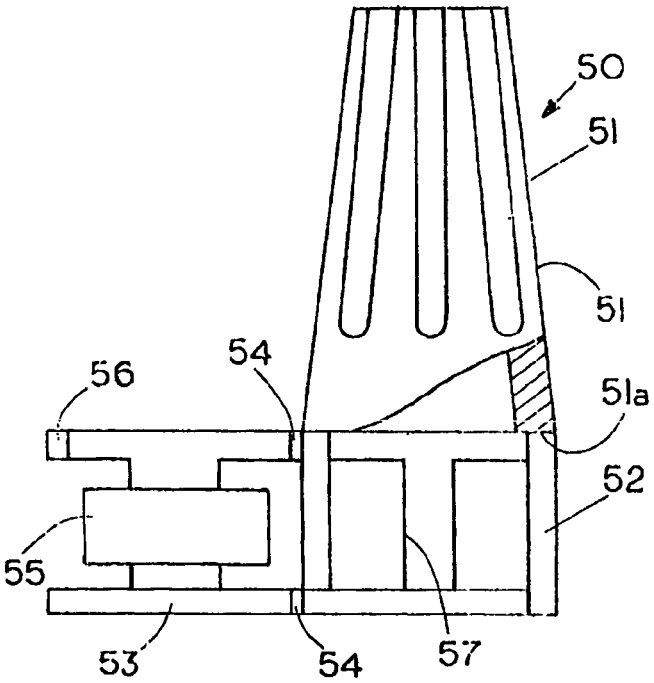
FIG. 7 is a side view of an alternate embodiment of a strain inhibiting twist-on wire connector an open face condition.

FIG. 7 is a side view of an alternate embodiment of a strain inhibiting twist-on wire connector 50 in an open face condition comprising a twist-on wire connector 51 having a wire engaging member 52 secured to an end face 51*a* of wire connector 51. Wire engaging member includes a first pad 57 and a second pad 55 which can be brought into a face to face position by pivoting a clamp member 53 about a living hinge 54. A latch 56 is located at the end of member 53 for engaging with member 52 to hold the wire engaging member 52 in a closed condition about a wire or wires located in the twist-on wire connector.

Figure 8:
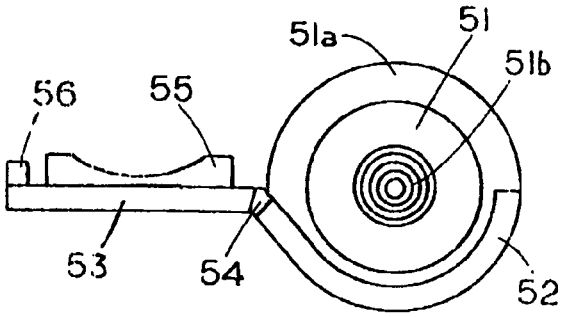
FIG. 8 is an end view of the strain inhibiting twist-on wire connector of FIG. 7.

FIG. 8 is an end view of the strain inhibiting twist-on wire connector 50 in the open condition showing that the wire holder comprises a wire engaging member 52 having a curved portion that is secured to end face 51*a* of wire connector 51. Wire engaging member 52 can be secured in any of a number of ways including adhesively securing as well as being integrally molded with the shell of the twist-on wire connector. Although member 52 is secured to end face 51*a* it is understood that member 52 can be secured to other portions of the twist-on wire connector including the interior of the twist-on wire connector. As can be seen in FIG. 8 one can engage wires in the twist-on wire connector coil 51*b* without interference from the wire engaging members 52 since the wire engaging member is located radially away from the coil 51*b*.

Figure 9:
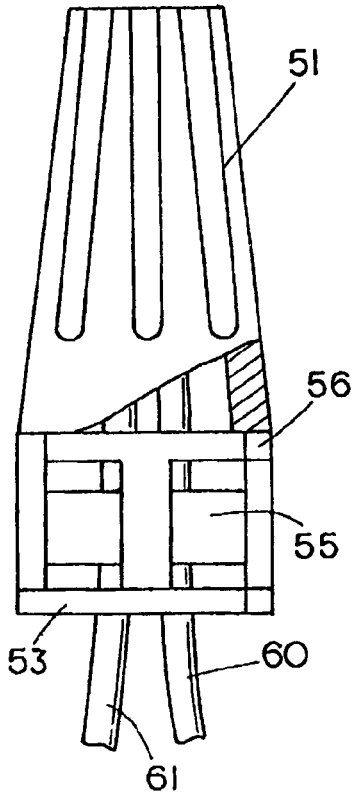
FIG. 9 is a side view of the embodiment of FIG. 7 in the closed strain relieving condition.

FIG. 9 is a side view of the embodiment of the strain inhibiting twist-on wire connector 50 in a closed condition about wires 60 and 61. In this condition clamp member 53 brings pad 55 proximate one side of wires 60 and 61 while the member 57 with the cross member are located on the opposite side of the wires thereby clamping the wires 60 and 61 therebetween so that any strain on the wires 60 and 61 is resisted by the clamping action of the wire engaging member 52 rather than by the electrical connection in the coil 51*b* of a twist-on wire connector.

Although a viscous sealant is described herein other sealants including epoxy sealants and other types of sealants such as fire retarding sealants can be used herein.

Figure 10:
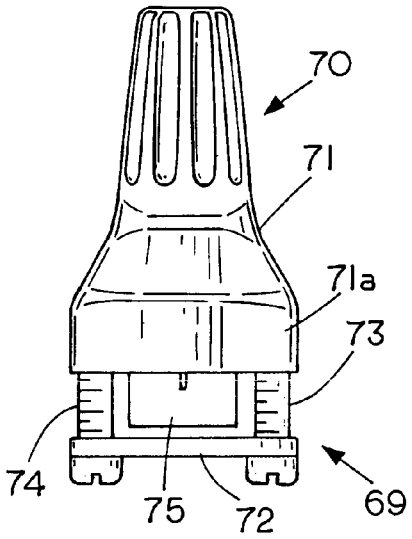
FIG. 10 is a front view of a twist-on wire connector with axial screw activated wire engagement member.
Figure 11:
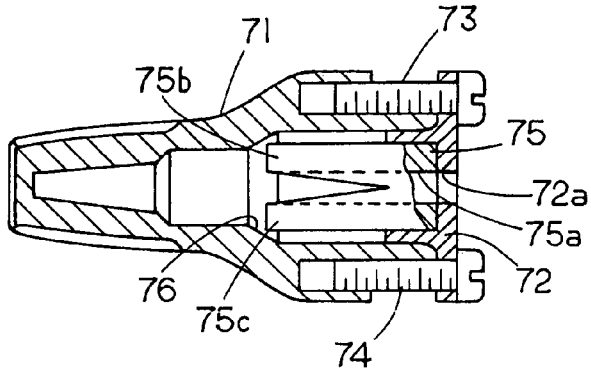
FIG. 11 is a section view of the twist-on wire connector of FIG. 10.
Figure 12:
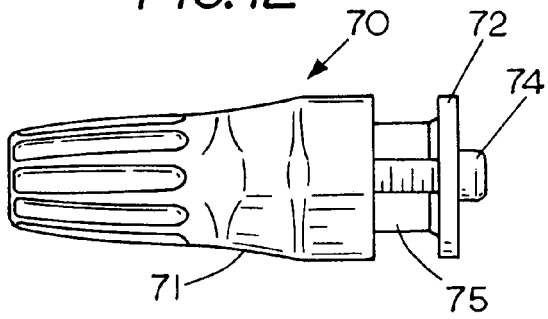
FIG. 12 is a side view of the twist-on wire connector of FIG. 10.

FIG. 10 to FIG. 12 show a twist-on wire connector 70 having an axial displacement mechanism 69. FIG. 10 is a front view of a twist-on wire connector 70 with the displacement mechanism 69 including wire engaging member 75 comprising a radially deformable member which is located partially in the open end of twist-on wire connector 71 and partially outside of the open end of wire connector housing 71*a*. A rigid collar 72 having a wire passage 72*a* therethrough extends across the end of wire connector 71. A first screw 74 and a second screw 73 extend through rigid collar 72 and each rotatingly engage housing 71 to provide for axial displacement of rigid member 72 toward wire connector housing 71*a* which in turn compresses deformable member 75 into the housing 71*a* of the twist-on wire connector 71.

FIG. 11 shows a cross section view of twist-on wire connector 71 that provides strain relief to wires held in the twist-on wire connector. The wire engaging member 75 is shown partially in section and having a central bore 75*a* with a first end 75*b* and a second end 75*c* cantilevered outward and spaced from each other. An annular converging surface 76 is located in twist-on wire connector 71 so that when wire engaging members 75 is axially displaced the ends 75*b* and 75*c* engage the annular converging surface 76 to radially displace the ends 75*b* and 75*c* to bring the wire engaging member 75 into extended frictional support with a wire or wires therein by radially compressing the deformable wire engaging member 75 about a wire or wires located in passage 75*a* that extends through deformable member 75. That is, annular converging surface 76 radially deflects cantilevered end 75*b* and cantilevered end 75*c* of a deformable member 75 radially inward around a wire or wires located in passage 75*a* to bring the deformable member into a frictional wire supporting condition. This type of unit is suitable where there may be little or not radial access to the wire connector 70.

Figure 13:
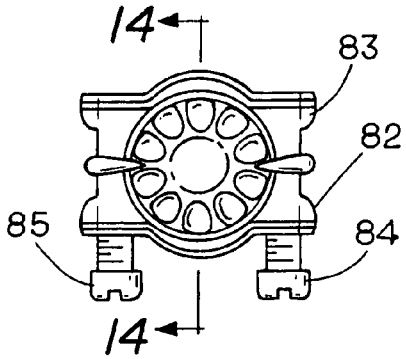
FIG. 13 is an end view of a twist-on wire connector with lateral screw activated wire engaging member.
Figure 14:
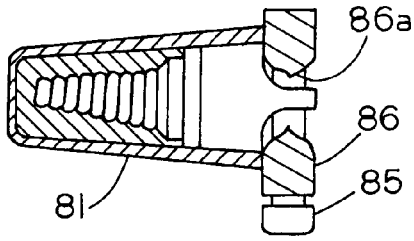
FIG. 14 is a section view taken along lines 14—14 of FIG. 13.
Figure 15:
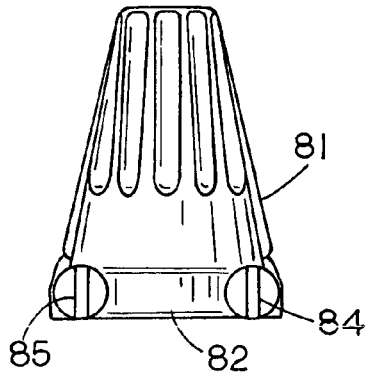
FIG. 15 is a front view of the wire connector of FIG. 13.

FIGS. 13–15 show an alternate embodiment of the twist-on wire connector 80 that can be used when there is little or no axial access but there is radial access to the wire connector. In the embodiment shown the slot headed compression screws 84 and 85 are positioned to move transverse to a plane extending axially through the wire connector. Twist-on wire connector 80 includes a housing 81 with a first end collar 82 carrying a first screw 84 and a second screw 85. Each of the screws 84 and 85 extend into a threaded recess in second collar 83 so that the screws 84 and 85 can be rotated to displace first radial compression member 82 and a second radial compression member 83 radially inward. The displacement of member 82 and 83 inwardly deforms the wire engaging collar 86 so that a wire or wires located in the bore 86*a* of the wire engaging member 86 are brought into a frictional wire supporting condition. The wire engaging member 86 comprises an elastomer member that is radially compressible about the exterior of a wire located in opening 86*a* to support the wires therein and provide strain relief to the wires secured in the twist-on wire connector 81.

Figure 16:
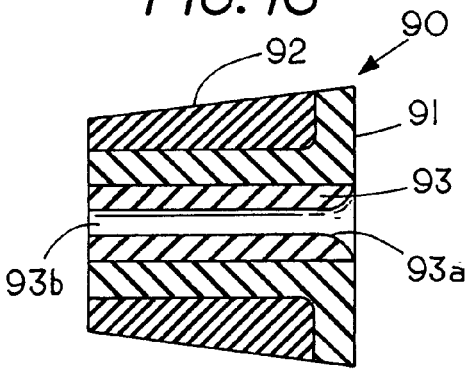
FIG. 16 is a section view of a wire engaging member having multiple materials.
Figure 16A:
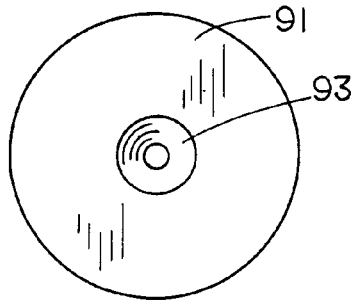
FIG. 16*a* is an end view of the wire connector of FIG. 16.

FIG. 16 is a sectional view of a wire engaging member 90 and FIG. 16*a* is an end view of the wire connector of FIG. 16. Wire engaging member 90 can be radially compressed about an axis extending axially through the wire engaging member. Wire engaging member 90 comprises multiple materials including an outer member 92, a flanged member 91 and a central deformable core 93 having a wire engaging surface 93*a* formed as part of the wire support mechanism. In the embodiment of FIG. 16 a variety of different materials can be arranged to provide enhanced wire supporting condition as the wire engaging member is radially compressed about a wire or wires located in central bore 93*b*. The deformable wire engaging core member 93 can be made of an elastomer with a lower durometer than the flange 91 or outer member 92. The use of multiple materials allows the user to provide for different wire supporting condition depending on the wires used in the twist-on wire connector. For example, more flowabilty might be required of core member 93*a* in order for the deformable material 93 to bring the core member into a frictional wire supporting condition or into a sealed condition around the wires located therein. Wire engaging member can be used with a radially compression device such as illustrated in the embodiment of FIG. 10 or the embodiment of FIG. 14.

Figure 17:
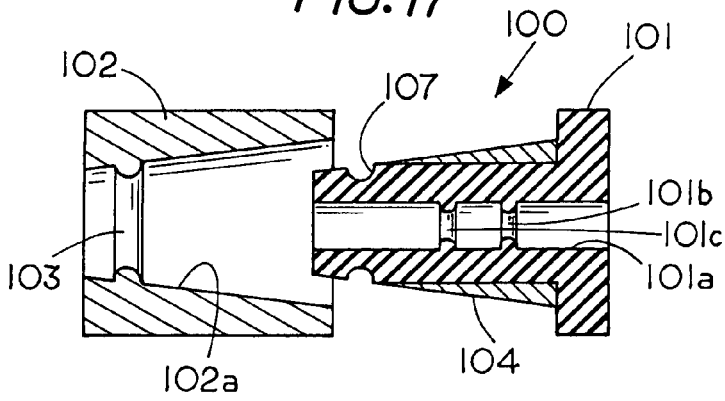
FIG. 17 is a partial sectional view of a wire engagement with a locking collar.

FIG. 17 is a partial sectional view of an alternate embodiment of wire engagement member 100 comprising a flanged shaped deformable member 101 with a rigid locking collar 102. Locking collar 102 contains a radially converging surface 102*a* and a radial bead 103 located proximate one end of the collar 102. The deformable compression member 104 that slidingly engages surface 102*a*. Located radially is a deformable member is an axial bore 101*a* with a first radial protrusion 101*b* and a second radial protrusion 101*c*.

In operation of the wire engagement member 100 the axial displacement of the rigid collar 102 with respect to the deformable member 101 causes the deformable member 101 to be radially compressed about a wire or wires located in axial passage 101*a* Deformable member includes protrusions 101*b* and 101*c* that project radially inward to provide localized engagement with a wire or wires in axial passage 101*a*. Located on the exterior of deformable member is an annular recess 107 that mates with annular bead 103 as the deformable member 101 is axially displaced into the collar 102. Once the annular bead 103 engages the annular recess it provides a retaining engagement between the collar and the deformable member 101 to hold the member in a radially compressed condition around a wire or wires located in the passage 101*a* Wire engagement 100 is suitable for direct connection to a twist-on wire connector and no screws or the like are need to hold the deformable member in a frictional wire supporting condition.

Figure 18:
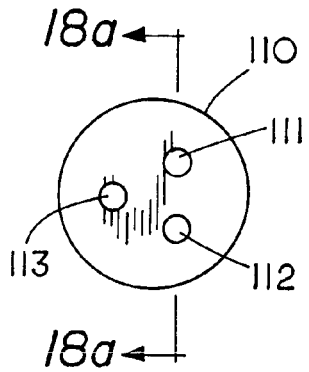
FIG. 18 is an end view of a wire engaging member having a plurality of passages for engaging wires therein.
Figure 18A:
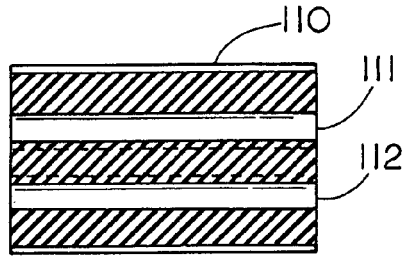
FIG. 18*a* is a cross sectional view of the wire engaging member of FIG. 18.

FIG. 18 is an end view of a wire holder or wire engaging member 110 and FIG. 18*a* is a cross sectional view of the wire engaging member of FIG. 18. The deformable wire engaging member has a plurality of axial passages 111, 112, and 113 for engaging wires in a frictional wire supporting condition. Wire engaging member comprises a deformable member and preferably an elastomer member that can be radially compressed about the axial passages to bring each of the sidewalls of the axial passages into a wire supporting condition. In the embodiment of FIG. 18 each of the wire passages can engage a single wire and thus provide 360 degree support as well as maintain the wires in spaced and strain relived condition. The embodiment of FIG. 18 is suitable for use in the type of a radial compression collar such as shown in FIG. 13.

Figure 19:
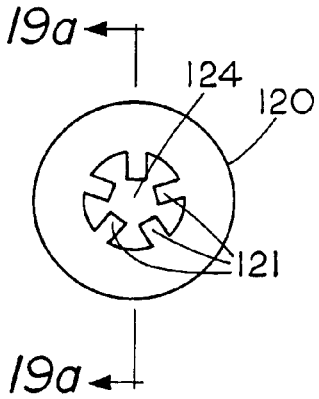
FIG. 19 is an end view of a wire engaging member having radial flutes.
Figure 19A:
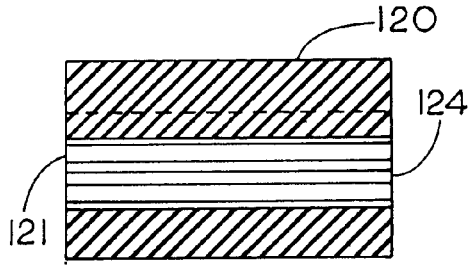
FIG. 19*a* is a sectional view of the wire engaging member of FIG. 19.

FIG. 19 is an end view of a radially deformable wire holder or wire engaging member 120 and FIG. 19*a* is a sectional view of the wire engaging member of FIG. 19. Wire engaging member 120 has radial flutes 121 that can be displaced radially inward to bring the flutes 121 into a frictional wire supporting condition about a wire or wires located in the axial passage through the axial passage 124 in the wire engaging member. Wire engagement member 120 can be made from a resilient deformable material such as an elastomer and is suitable for use with a lateral compression members such as shown in embodiment of FIG. 13.

Figure 20:
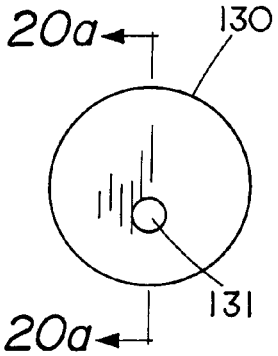
FIG. 20 is an end view of a wire engaging member having a non linear wire passage therein.
Figure 20A:
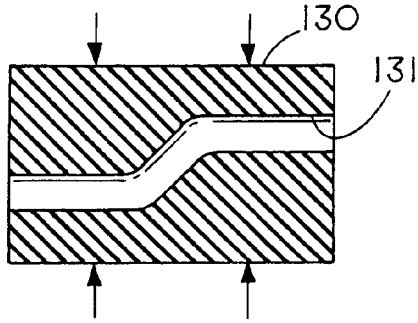
FIG. 20*a* is a section view of the wire engaging member of FIG. 20.

FIG. 20 is an end view of a wire holder or wire engaging member having a non linear wire passage therein and FIG. 20*a* is a section view of the wire engaging member of FIG. 20. Wire engaging member 130 contains an axially extending passage 131 that follows a non-linear path so that there is no see-through opening when the deformable member 130 is in a relaxed condition as shown in FIG. 20 and FIG. 20*a* In operation of the wire engaging member 130 a radial compressive force as indicated by the arrows causes the passage 131 to collapse about a wire or wires located in the passage 131. As the passage 131 follows a non-linear path portion of the passageway 131 collapse more quickly to bring a wire or wires therein into a frictional wire supporting condition. The embodiment of FIG. 20 is also suitable for use with a radially compression member as shown in FIG. 13.

It should be pointed out that the embodiment of FIG. 18, FIG. 19 and FIG. 20 while useable with a radial compression member can also be used with an axial displacement member by providing a converging outer surface on the exterior of the deformable member so that the axially displacement radially compress the deformable members about a wire or wires located in their axial passages.

Figure 21:
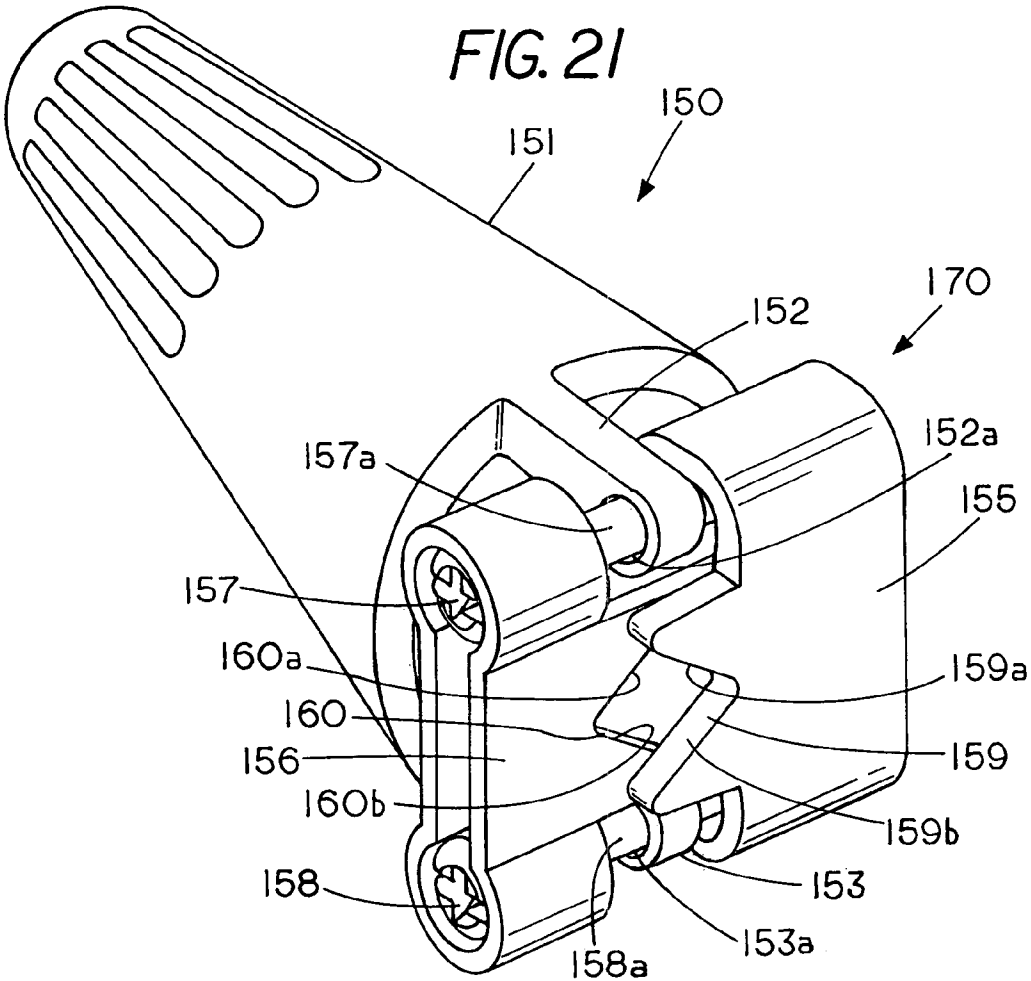
FIG. 21 is a pictorial view of a strain relief wire connector with jaws that radially compress the wires to frictional hold the wires.

FIG. 21 is a pictorial view of a strain relief wire connector 150 with a wire holder 170 with wire engageable jaws 159 and 160 that are radially compressible about a wire or wires to frictionaly hold the wires proximate a twist-on wire connector 151 in a strain free condition. Wire holder 170 comprises a first member 155 having a v-shaped jaw 159 formed by an upper jaw face 159*a* and a lower jaw face 159*b*. Similarly, a second member 156 includes a v-shaped jaw 160 formed with an upper jaw face 160*a* and a lower jaw face 160*b*. Located in member 156 is a first screw 157 that has a shank 157*a* and a threaded end (not shown) that extends into a threaded recess (not shown) in member 155 and a second screw 158 that has a shank 158*a* and a threaded end (not shown) that extends into a threaded recess (not shown) in member 155. Rotational engagement of screws 157 and 158 in a first direction causes members 155 and 156 to bring jaws 159 and 160 toward each other to radially compress a wire or wire located therein. Similarly, rotation of screws 157 and 158 in the opposite direction cause the jaws 159 and 160 to release a grip on any wires located in the jaws.

Attached to the wire holder 170 is a first housing extension 152 having an opening 152*a* therein for shank 157*a* to extend through. Similarly, a second housing extension 153 has an opening 153*a* for engagement with shank 158*a*. The wire holder 170 is maintained proximate the open end of wire connector 151 to engage wires to be extended through the jaws 159 and 160 and into the twist-on wire connector 151 where the wires are brought into low resistance contact with each other.

In the embodiments shown in FIG. 21 the twist-on wire connector 151 and wire holder 170 provides the benefit of being able to attach the wire holder after the wires have been joined in the twist-on wire connector. That is, the wire can be joined in the twist-on wire connector and the members 155 and 156 can be placed on opposite sides of the wire and the screws 157 and 158 can be threaded into member 155 by extending the screws through the opening 152*a* and the opening 153*a* to thereby axially restrain the wire holder 170 proximate the open end of twist-on wire connector 150.

Figure 22:
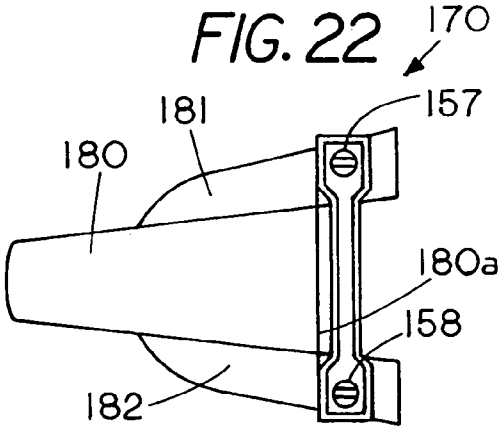
FIG. 22 is a n end view of an alternate embodiment of a strain inhibiting member or wire holder secured to wings on the twist-on wire connector.
Figure 23:
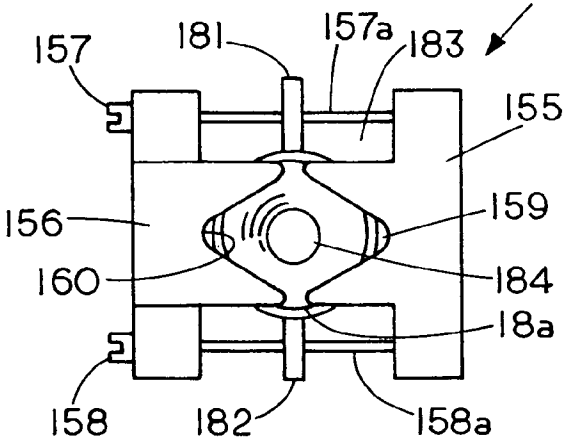
FIG. 23 is a side view of the twist-on wire connector of FIG. 22.

FIG. 22 and FIG. 23 show an alternate embodiment of twist-on wire connector 180 in use with the wire holder 170. In the embodiment shown the wire connector 180 is provide with a first radial wing 181 and a second radial wing 182. The radial wings 181 and 182 extend past the housing open end 180*a* and each include an opening therein. That is fastener 157 extends through an opening (not shown) in wing 181 and fastener 158 extends through an opening (not shown) in wing 182 to hold the wire holder 170 proximate the housing open end 180*a*. In the embodiment shown in FIGS. 22 and 23 the open end of the wire connectors and the jaws 159 and 160 can be spaced apart so as to provider greater access to the open end 180*a* of the wire connector. A wire coil 184 is located in the housing closed end.

In the embodiment shown in FIGS. 21–23 the jaws are formed of a rigid or non-deformable material and the radially compression of the jaws on the insulation of the wires provides for the frictional engagement that prevents the wire or wires from being axially displaced. If desired a deformable material can be placed on the jaws for engagement with a wire or wires therein.

Thus the invention includes a method of inhibiting wire strain in a twist-on wire connector by forming a wire connection in the twist-on wire connector 180, securing a wire holder 170 proximate an open end 180*a* of a twist-on wire connector to axially restraining a wire from the wire connection in the wire holder 170 to inhibit axial displacement of the wire and thereby inhibit strain on the wire connection in the twist-on wire connector.

The invention further includes a strain relief twist-on wire connector comprising a twist-on wire connector 151 and a wire holder 170 secured to the twist-on wire connector with the wire holder in compressive engagement with a wire extending into the twist-on wire connector, for inhibiting an axial wire displacement of the wire with respect to the twist-on wire connector to thereby inhibit strain on a wire connection in the twist-on wire connector.

We claim:

1. A strain relief twist-on wire connector comprising:

a twist-on wire connector:

a wire holder secured to the twist-on wire connector, said wire holder in compressive engagement with a wire extending into the twist-on wire connector, said wire holder inhibiting an axial wire displacement of the wire with respect to the twist-on wire connector to thereby inhibit strain on a wire connection in the twist-on wire connector, said wire holder including a first screw fastener extending through a first extension on a wire connector housing and a second screw fastener extending through a second extension on the wire connector housing with the first and second extension retaining the wire holder proximate the end of the wire connector housing.

2. The strain relief twist-on wire connector of claim 1 including rigid jaws slidable toward each other to clamp the wire extending into the wire connector.

3. A strain relief twist-on wire connector comprising:

a twist-on wire connector; and a wire holder secured to the twist-on wire connector, said wire holder in compressive engagement with a wire extending into the twist-on wire connector, said wire holder inhibiting an axial wire displacement of the wire with respect to the twist-on wire connector to thereby inhibit strain on a wire connection in the twist-on wire connector, and said wire holder including a pair of rigid v-shaped jaws.

4. A strain relief twist-on wire connector comprising:

a twist-on wire connector;

a wire holder secured to the twist-on wire connector, said wire holder in compressive engagement with a wire extending into the twist-on wire connector, said wire holder inhibiting an axial wire displacement of the wire with respect to the twist-on wire connector to thereby inhibit strain on a wire connection in the twist-on wire connector, and;

jaws, said jaws spreadable to form an opening of substantially the same size as an open end of a wire connector housing of the twist-on wire connector to enable securement of a wire in the housing of the wire connector through the wire holder.

* * * * *